US005394909A

United States Patent [19]

Mitchell et al.

[11] Patent Number: 5,394,909

[45] Date of Patent: Mar. 7, 1995

[54] VAPOR CONTROL VALVE

[75] Inventors: Thomas O. Mitchell, Maryland Heights; Arthur C. Fink, Jr., Lonedell, both of Mo.

[73] Assignee: Husky Coprpration, Pacific, Mo.

[21] Appl. No.: 59,984

[22] Filed: May 12, 1993

[51] Int. Cl.[6] ..... B67D 5/04

[52] U.S. Cl. ..... 141/59; 141/44; 141/45; 141/302; 141/226; 137/587

[58] Field of Search ..... 141/44–46, 141/59, 302, 206–229; 137/587–589

[56] References Cited

U.S. PATENT DOCUMENTS

| | | | |
|---|---|---|---|
| 2,083,078 | 6/1937 | Mayo . | |
| 3,502,121 | 3/1970 | Moore et al. | 141/207 |
| 3,710,831 | 1/1973 | Riegel | 141/207 |
| 3,753,453 | 8/1973 | Madden et al. | 141/387 |
| 3,907,010 | 9/1975 | Burtis et al. | 141/45 |
| 3,946,771 | 3/1976 | Braun et al. | 141/59 |
| 3,996,979 | 12/1976 | Barr et al. | 141/302 |
| 4,018,252 | 4/1977 | Burtis et al. | 141/45 |
| 4,057,085 | 11/1977 | Shihabi | 141/59 |
| 4,057,086 | 11/1977 | Healy | 141/205 |
| 4,199,012 | 4/1980 | Lasater | 141/52 |
| 4,343,337 | 8/1982 | Healy | 141/226 |
| 4,351,375 | 9/1982 | Polson | 141/302 X |
| 4,429,725 | 2/1984 | Walker et al. | 141/59 |
| 4,497,350 | 2/1985 | Guertin | 141/206 |
| 4,825,914 | 5/1989 | Leininger | 141/59 |
| 4,827,960 | 5/1989 | Mitzberg et al. | 141/59X |
| 5,078,188 | 1/1992 | Nitzberg et al. | 141/207 |
| 5,234,036 | 8/1993 | Butkovich et al. | 141/302 |
| 5,273,087 | 12/1993 | Koch et al. | 141/59 X |
| 5,285,826 | 2/1994 | Sanders et al. | 141/59 |
| 5,289,856 | 3/1994 | Shock et al. | 141/59 |

*Primary Examiner*—Ernest G. Cusick
*Attorney, Agent, or Firm*—Paul M. Denk

[57] ABSTRACT

A vapor valve for use in conjunction with the fuel dispensing nozzle for capturing vapors returned through the nozzle to a storage area, the nozzle incorporating a body, a spout extending forwardly therefrom, and the nozzle having an operating latch pin and housing for normally providing for opening or shut-off of the nozzle during a dispensing function, a vapor passageway extending through the spout, communicating into the latch pin housing, and extending through the nozzle body for return of vapors back to a storage area, and a latch ring operatively associated with the latch pin and providing for opening or closure to the vapor port of the latch pin housing to furnish its opening while fuel is being dispensed for return of vapors to a storage area, or when the fuel dispensing function is curtailed, providing for an upward shifting of the latch ring within the housing for closure of its associated vapor port and preventing the escape of vapors to the atmosphere.

8 Claims, 4 Drawing Sheets

VAPOR CONTROL VALVE

BACKGROUND OF THE INVENTION

A variety of check valve means have been incorporated within fuel dispensing nozzles, for many years, and which provide for either the control of the fuel being dispensed, or to regulate the vapors that may be returned back through the nozzle, during their collection, particularly in those devices designed for achieving Stage II type of vapor recovery, in the design and functioning of fuel dispensing nozzles. As is well known, many jurisdictions now require that the discharge of vapors to the atmosphere, during fuel dispensing, as at the service station, be substantially eliminated. Hence, generally, two types of nozzles have been devised, one is the vacuum assist type, wherein a vacuum pump means locates either in the dispenser or in the underground fuel storage tank, or at some other location, which provides for a reduction of pressure and the attraction of vapors back into the nozzle, for return and collection, to prevent their discharge into the atmosphere. Furthermore, the balanced pressure type of vapor recovery, normally of the type that incorporates a bellows means for sealing against the automobile fill pipe that leads to the gasoline tank, provides means for collecting vapors, that are forced back out of the vehicle fuel tank, as gasoline is dispensed therein, with such vapors being returned through a bellows means arranged concentrically upon the nozzle spout, and then returned back through the nozzle to the storage location. Generally, either one of these instruments normally include some type of check valve means, located at some region within the vapor flow path, of the nozzle, for preventing the release of vapors back into the atmosphere, particularly after a nozzle dispensing function has been concluded.

There are a variety of patents that disclose various types of vapor seals, such as when gasoline is being dispensed, in order to prevent its escape, such as shown in the U.S. Pat. No. to Madden, 3,753,453. The U.S. Pat. No. to Burtis, 3,907,010, discloses an anti-pollution service station assembly, wherein a seal is made by means of a vapor member, in the vicinity of a valve, to allow the passage of vapors through various ports, as when gasoline is being dispensed, but to provide for its closure when fuel dispensing ceases. The U.S. Pat. No. to Braun, 3,946,771, shows a type of check valve, which appears to be a type of flapper valve, for curtailing the passage of vapors, when dispensing of fuel has shut-off. The U.S. Pat. No. 4,018,252, also to Burtis, is similar to his previously described patent. This particular device operates off of the poppet stem for the shown nozzle.

The U.S. Pat. No. 4,057,085, shows another form of vapor recovery system, but it locates its recovery means within the dispenser, rather than at the nozzle. U.S. Pat. No. 4,199,012, discloses a vapor recovery arrangement, but obviously the vapors pass through the vapor recovery tube incorporated into the nozzle guard. A patent to Healy, U.S. Pat. No. 4,343,337, upon a fuel dispensing nozzle, shows a poppet valve that apparently provides for sealing of a vapor return line, as through its nozzle, and this vapor return path apparently is sealed by means of a valve seal, operated by the poppet stem.

The patent to Walker, U.S. Pat. No. 4,429,725, discloses a check valve that provides for passage of vapors through and to the vapor recovery conduit. The U.S. Pat. No. 4,825,914, shows another vapor check valve, to curtail the flow of vapors, when the nozzle is withdrawn from a fuel tank. The U.S. Pat. No. to Nitzberg, 4,827,960, shows a vapor control means embodied in a breakaway swivel coupling.

Another U.S. Pat. No. 4,497,350, upon a vapor recovery system, shows an automatic shut-off feature for the nozzle that relates to its opening and closure of a valve, that regulates the flow of liquid, but not vapors, as such passes through the shown nozzle.

The U.S. Pat. No. to Barr, 3,996,979, shows a valve means which is rendered operative by the elevation of a popper stem.

Other United States patents showing various types of mechanisms for automatic nozzles are disclosed in the patent to Moore, U.S. Pat. Nos. 3,502,121, 2,083,078, and 3,710,831.

SUMMARY OF THE INVENTION

This invention relates principally to the adaptation of closure valve means that is operatively associated with the latch pin and plunger mechanism, located within the latch pin housing for the fuel dispensing nozzle, and which is automatically opened, or closed, to allow the passage or blockage of vapors, depending upon the condition of usage, or nonusage, of the fuel dispensing nozzle.

The subject of this invention is to provide a standard type of nozzle, particularly one used in vapor recovery, wherein valve means is located within the region of its diaphragm that renders the nozzle automatically operative, particularly when providing for automatic shut-off of the nozzle when fuel has reached a fill level in the vehicle tank, or which is sensitive to excessive pressure buildup, that provides for curtailment in the dispensing of fuel, in the event that an overpressure condition is sensed and detected in the vehicle tank. Generally, the vapor valve means of this invention is located in the region of the diaphragm, or below thereof, at the position of it release stem, wherein the valve seat and a latch ring cooperate to provide for opening of the vapor return passageway, as when fuel is being dispensed, to allow a return of vapors back to the storage area, or for closure of the vapor return passageway, as by the gasket formed of the latch ring entering into a sealing contact with the latch valve seat, in order to close off the vapor return passageway, to retain and capture those vapors that had been returned back to this location, and prevent their untimely passage or escape into the atmosphere, as prohibited by various codes, as explained previously.

In this particular embodiment, when the nozzle handle is compressed, to provide for dispensing of fuel through the nozzle, after its spout has been inserted into the vehicle tank, this provides for a draw down of the latch ring formed gasket, to open the vapor return passageway, but that when fuel dispensing is curtailed, either when the tank has reached a fill condition, or automatically shut-off when the monetary amount of purchased gas desired has been reached, or when an overpressure condition occurs, the latch pin functions in conjunction with its upperwardly disposed diaphragm, is pulled up therein to provide for the latch mechanism balls to shift inwardly, allowing for the plunger to drop downwardly, with the latch ring shifting by means of its spring biased pressure upwardly, thereby curtailing the flow of fuel through the nozzle by allowing the poppet to close, but simultaneously, shifting the latch ring upwardly against its valve seat, to close off the vapor return passageway, and capture, at this point, those vapors which have been returned to storage, either by the balance pressure method, or by the vacuum assist system, as previously analyzed.

It is, therefore, the principal object of this invention to provide means in cooperating with the latch pin and plunger mechanism for opening of the vapor return passage when fuel dispensing is initiated, through a fuel dispensing nozzle, or to promptly curtail the same, and capture those vapors that have been returned, immediately, when a fuel dispensing operation has ended.

Another object of this invention is to provide operative components with the latch housing, of a fuel dispensing nozzle, to provide locating of a valve seat proximate the vapor return passageway, and to dispose the same in proximity with the latch ring, modified to form a type of valve and gasket, which when biased by means of spring pressure into contact with its seat, capturing any vapors that have been returned through the nozzle during its dispensing function.

These and other objects will become more apparent to those skilled in the art upon reviewing the subject matter of this invention as summarized herein, and upon undertaking a study of the description of the preferred embodiment, in view of the drawings.

BRIEF DESCRIPTION OF THE DRAWINGS

In referring to the drawings, FIG. 1 provides cross-sectional view of a fuel dispensing nozzle, showing its various housing and spout components, and the diaphragm and latch operative components used in conjunction with the vapor return path of this invention.

DESCRIPTION OF THE PREFERRED EMBODIMENT

Figure 1:
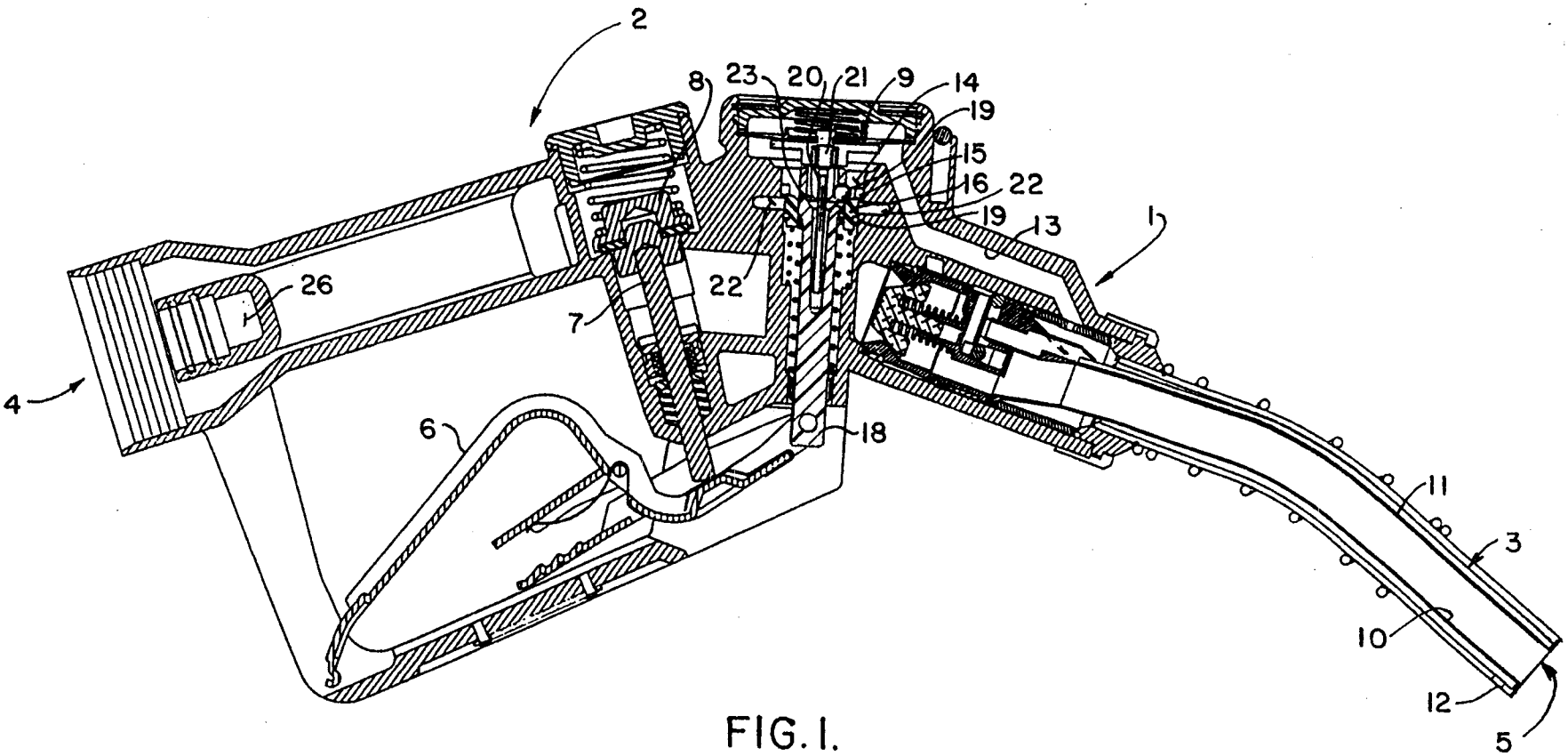
Figure 3:
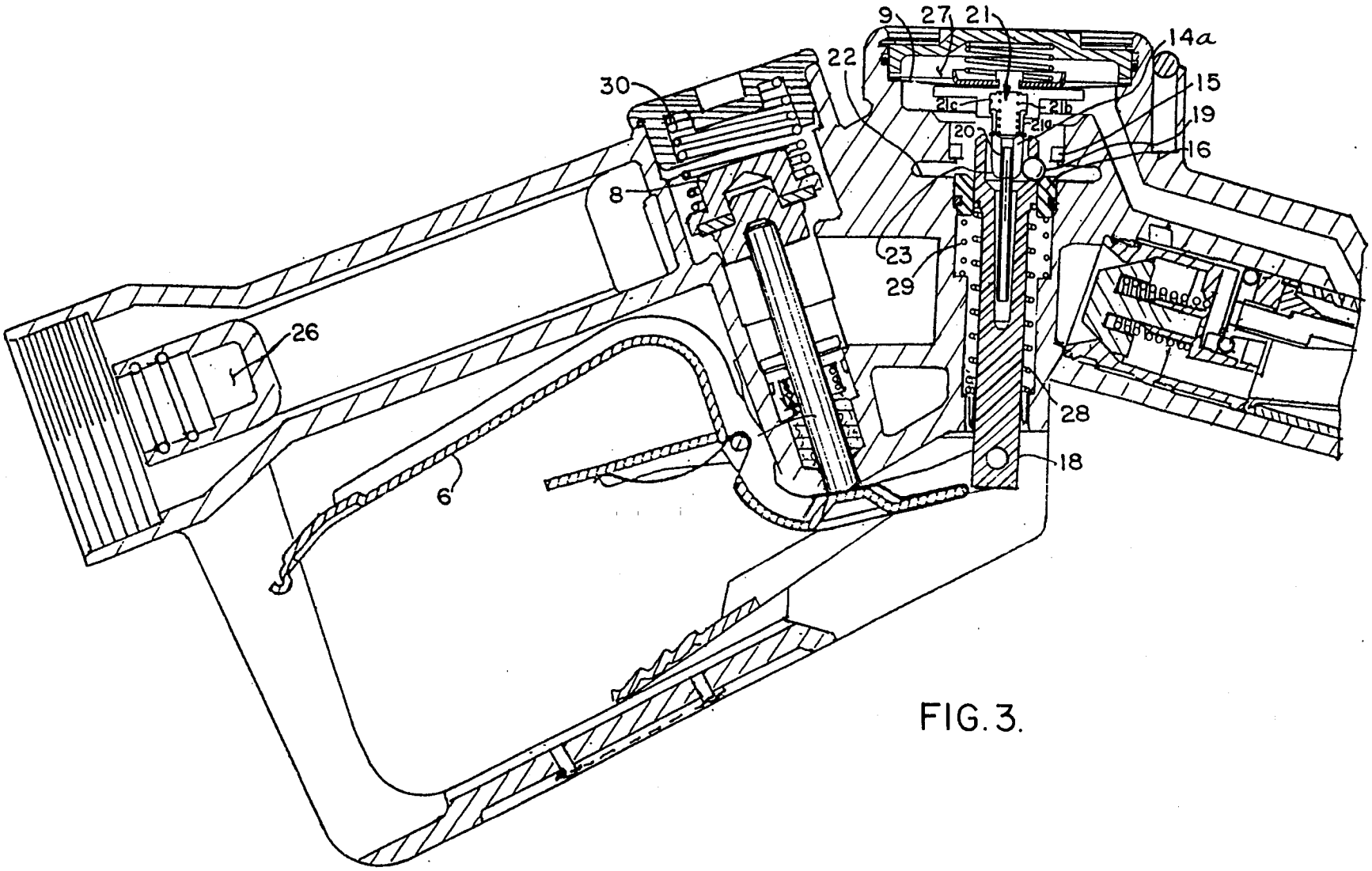
FIG. 3 is a similar view to that of FIG. 2, but with the hand lever for the nozzle being compressed, to provide for fuel dispensing, and likewise opening of the vapor valve means associated within the latch housing to provide for return of vapors back through the nozzle and to the location of storage.

In referring to the drawings, and in particular FIG. 1, a fuel dispensing nozzle 1 is disclosed, incorporating a nozzle body 2 and a forwardly disposed spout 3, with the fuel being dispensed through the nozzle entering the back end of the nozzle handle, as at 4, and exiting at the front of the spout, as at 5, for delivery to the vehicle fuel tank. The nozzle also incorporates a handle means 6, which when squeezed upwardly, as shown at FIG. 3, operates upon a poppet stem 7 to open the poppet valve 8 to allow the dispensing of fuel through the nozzle. In addition, a diaphragm 9 is responsive to various vapor pressures, and provides for the automatic shut-off of the nozzle, either when the vehicle fuel tank is filled, or when an over pressured condition may be sensed, all as commonly employed in prior art nozzles.

The principal feature of this invention is to provide for vapor recovery through the nozzle. As previously explained, there are generally two types of vapor recovery nozzles, one is the vacuum assist type, constructed in accordance with that as shown in FIG. 1, whereas the other type, which usually includes a sizeable bellows concentrically located upon the spout, collects vapors within the interior of the bellows, for delivery through the nozzle, and also back to a storage area, whether it be the underground storage tank, or some other collection location.

In the nozzle as shown, an internally arranged fuel flow path is provided at 10, and the space between the fuel conduit 10 and the interior of the spout 3, as can be seen at 11, provides for the return of vapors through the port 12, traverses the spacing 11, upwardly through a channel 13 provided within the front of the nozzle housing, and to a position at the underside of the diaphragm 9, as can be seen. The latch or plunger housing 14 is also exposed to the returned vapors. At this juncture, it can be seen that a valve seat 15 is permanently affixed within the latch housing, and it is disposed for being contacted by the latch ring or valve closure means 16, closure is provided at that location to prevent passage of any vapors contained thereat. This valve means or latch ring normally is fabricated of a stainless steel, or other type metal, or may be formed of a gasket like material, such as a polymer, and disposed for slight vertical shifting within the latch or plunger housing 14, and is generally hermetically sealed therewith, by means of the O-ring 17, as noted.

Figures 4, 5:
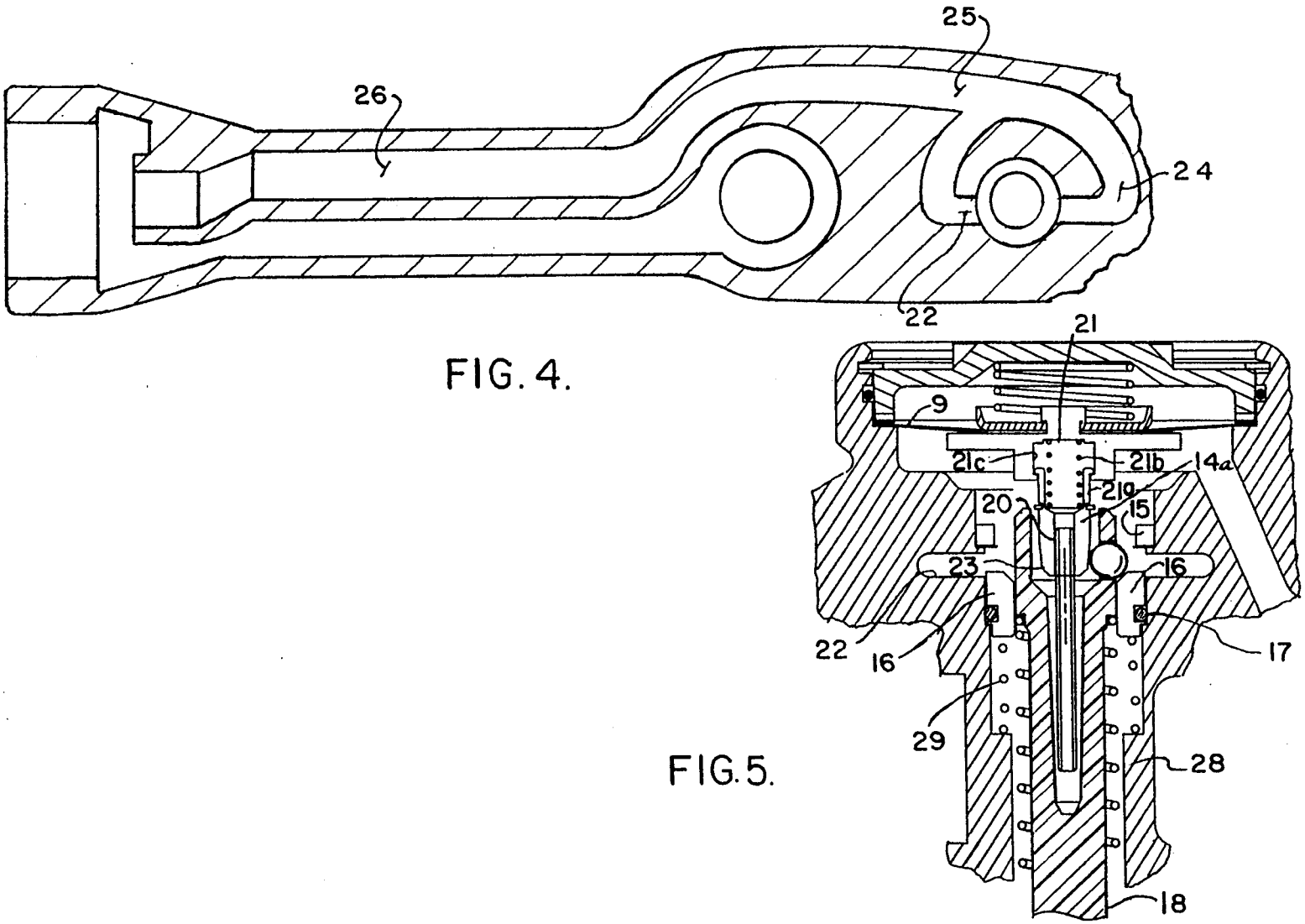
FIG. 4 is a sectional plan view of the nozzle housing, disclosing the vapor path through the nozzle body, and its extending into the location of the latch housing, and its vapor valve components, to provide for the return, or hold, of vapors passing through the nozzle.
FIG. 5 is an enlarged view of the automatic shut-off, housing, and components shown in FIG. 3.

The latch mechanism for the nozzle includes a latch plunger, as at 18, which is pivotally mounted at its lower end to the front end of the handle 6. The latch plunger extends upwardly, into the latch housing, and disposes a series of latch balls 19, generally three in number, within spaced apertures provided at triangulated locations around the upper proximate end of the said plunger 18. The latch balls, in combination with the plunger, and the internally arranged latch pin 20, generally fixes the latch mechanism for the nozzle at the position as shown in FIG. 1, when the nozzle is shut off, or even when fuel dispensing is initiated. Thus, when the handle 6 is raised, or compressed upwardly, and pushes upon the poppet stem 8, it forces the poppet valve 8 off of its seat, to allow for fuel to flow through the nozzle. Under that condition, the latch pin has a degree of play provided between it, and where it connects by means of linkage, as at 21, to the underside of the diaphragm 9. As can be seen, this linkage 21 includes a link **21*a* that is normally spring biased downwardly, by means of the spring 21*b*, but does have sufficient vertical play, as along the channel provided within the diaphragm support 21*c*, as can be noted. That slight degree of play allows for the latch plunger, and its ball, in addition to the latch pin, to be pulled slightly downwardly, as for example, for a sixteenth (1/16) or eighth (⅛) of an inch, just enough for the balls 19 to compress against the upper edge of the latch ring 16, and to force it downwardly, to provide its disengagement from the valve seat 15, and to provide for some opening for the channel 22, to allow for vapors to pass into the channel 22, for return further rearwardly through the nozzle, for collection. The latch balls 19 are held against the upper edge of the latch ring 16, because of their contact against the outer surface of the latch pin 20, and above its tapered edge 23, as noted. Under those circumstances, any vapors that are returned into the chamber 22 pass into the communicating channel 24 through the passageway 25, and into the vapor return passageway 26 for return through the handle portion of the nozzle, and channeled into that part of the fuel dispensing hose, that returns vapors back to the dispenser, whether it be of the concentric type of hose, or parallel type of hose, as well known in the art. See also FIG. 4**.

Figure 2:
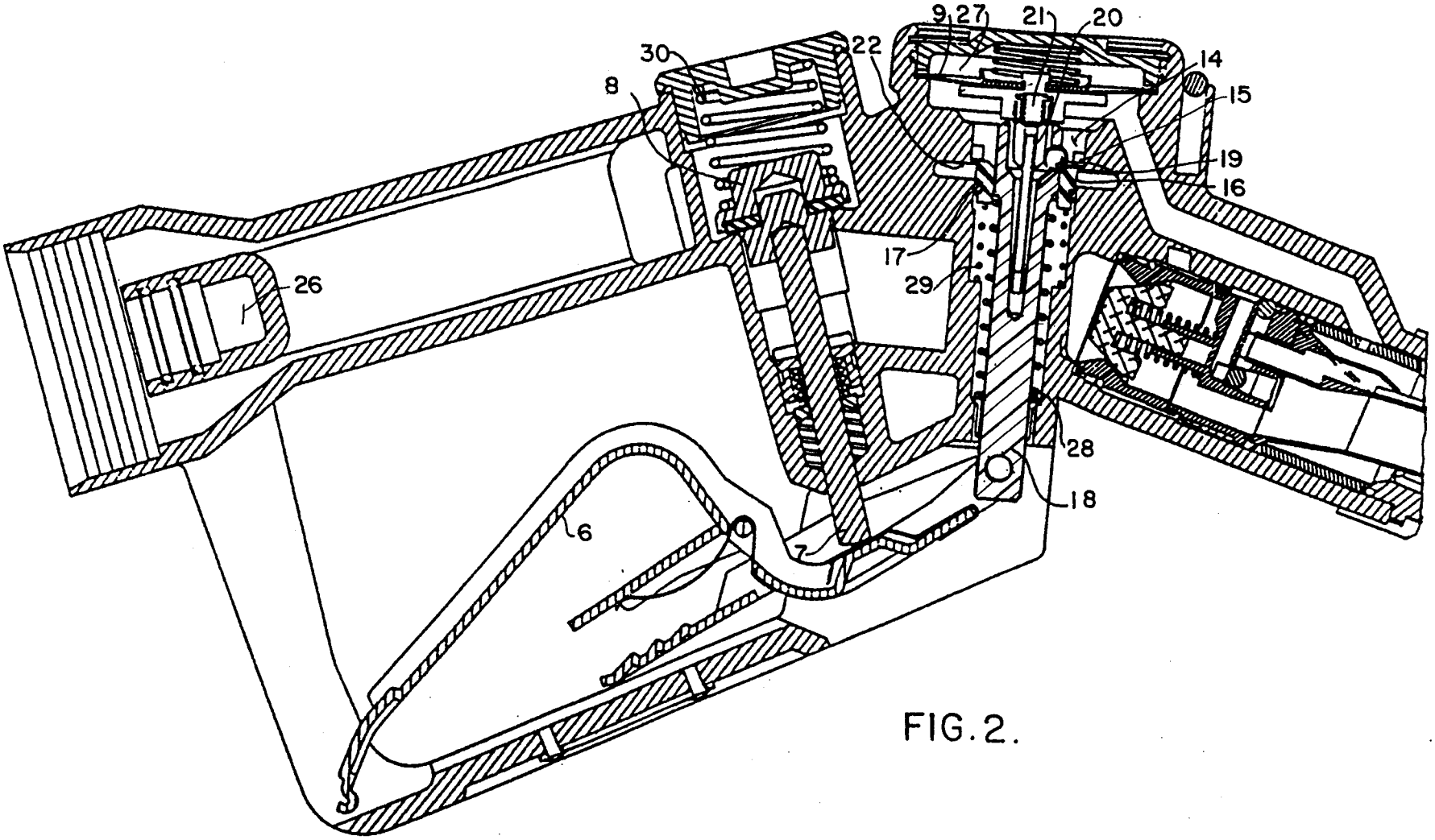
FIG. 2 is an enlarged view of the nozzle body, showing the latch mechanisms, held in closure, to prevent the escape of vapors, as-when the nozzle is not in use.

FIG. 2 provides a view similar to that as shown in FIG. 1, in a slightly enlarged scale, and discloses the disposition of the various operating components of the nozzle, particularly at its diaphragm and latch mechanism area, when the nozzle is not in use, and its latch ring and gasket 16 is maintained in closure against the valve seat 15, to retain returned vapors within the nozzle, and back in the storage area, to prevent their escape from the nozzle or inadvertent release into the atmosphere. This particular figure discloses the status of the nozzle, when a dispensing function has been curtailed, and the nozzle is not in use.

On the other hand, as previously explained, FIG. 3 shows the nozzle during a dispensing function, and when used in that capacity provides for return of vapors back through the nozzle and to the storage area, for collection. As can be seen, when the nozzle handle 6 has been compressed or squeezed, to provide for a lift-off of the poppet 8 to afford fuel dispensing, at that time, as the handle 6 is squeezed, the plunger 18 is pulled slightly downwardly, to the extent as previously explained, which further pulls down at a limited degree upon the latch pin 20, and the latch plunger, thereby forcing the latch balls 15 to push the latch ring 16 downwardly, to some extent, to provide for an opening between the latch ring 16, and the valve seat 15, to allow the vapors to pass from the latch housing opening **14*a* and into the chamber 22, and through the nozzle vapor passageways 24, 25, and 26**, as aforesaid, for return to storage.

But, when fuel dispensing is curtailed, as for example, when the liquid level of the fuel being dispensed into the vehicle fuel tank reaches a fill level, and the pressure to the upper side of the diaphragm, as at 27, is substantially reduced, or cut off, as known in the art, this forces an upward pull of the diaphragm 9, effecting an upward shift of the latch pin linkage 21, which pulls the latch pin up, provides the latch balls 19 to clear the lower taperered portion 23 of the latch pin, thereby forcing the balls inwardly, at which time the plunger 18 is allowed to move downwardly, as by means of the pressure poppet spring 30, while simultaneously the latch ring spring 29 forces the latch ring or valve 16 upwardly into engagement against the valve seat 15, closing off the chamber 22, and preventing any of the captured vapors from returning through the nozzle and being discharged out of its spout 3. When the latch pin is pulled up, the balls move inwardly, and the plunger moves down, shutting off the fuel flow through the poppet, and the latch ring or valve 16 then moves upwardly, and closes off the vapor valve chamber 22. When the handle is released, the plunger spring 28 moves the plunger back up within the housing 14 of this automatic shut-off means for the nozzle. See also FIG. 5. As known, and as standard in the art, when this occurs, the handle 6 promptly pivots downwardly, allowing the poppet stem 7 to drop, furnishing a closure to the poppet 8, under the force of its spring 30, to prevent the further dispensing of fuel, simultaneously.

Thus, the concept of this invention is to provide means that functions in cooperation with the manipulation and automatic maneuvering of the latch mechanism contained within the fuel dispensing nozzle, to provide for opening or shut-off of the vapor return passageway, and to function as a check against the untimely discharge of vapors, as when the nozzle is shut off, and not in use, or to provide for the return and capture of collected vapors through the nozzle, as when a fuel dispensing function is undertaken, and the vapor return passageway is cleared to provide for the routine attraction of vapors therethrough, either by means of vacuum attraction, as in the vacuum assist method, or by the forced pressurization of the vapors through the nozzle and back to the storage area, as occurs in the balanced pressure type of vapor collecting fuel dispensing nozzle.

Variations or modifications to the subject matter of this invention may occur to those skilled in the art upon reviewing the disclosure herein. Such variations, if within the spirit of this invention, are intended to be encompassed within the scope of any claims to patent protection issuing upon this invention. The description of the preferred embodiment set forth herein is done so for illustrative purposes only.

Having thus described the invention, what is claimed and desired to be secured by Letters Patent is:

1. A vapor valve for use in conjunction with a fuel dispensing nozzle, wherein the vapors are returned through the nozzle during recovery for transfer back to the underground fuel tank or other storage area, said nozzle incorporating a handle and body, and having a spout extending forwardly therefrom, the nozzle incorporating an operating latch ring and plunger provided within a plunger housing, the body and spout having a passageway provided therethrough for communicating vapors collected at the automobile tank for return through the spout, and the nozzle body, for collection, a vapor return passageway communicating with the plunger housing of the nozzle body, said plunger housing cooperating with the nozzle body for return of the collected vapors through the nozzle body during the dispensing of fuel, valve seat means operatively associated with the latch ring shiftably contained within the plunger housing whereby when said latch ring shifts against the valve seat means provides for closure of the vapor return passageway when the dispensing of fuel is curtailed and preventing the escape of the collected vapors from the nozzle body to the atmosphere during nonusage of the nozzle, said vapor passageway includes a vapor port opening into the plunger housing proximate the location of the shiftable latch ring, and a latch pin operatively associated with the latch ring and positioned for providing one of blockage to the passage of vapors through the said port through sealing of the latch ring against the valve seat means, and shifting of said latch ring for opening of said port to allow the return of vapors back-to a storage area.

2. The invention of claim 1 and including spring means operatively associate with said latch ring to facilitate its shifting between its operative positions.

3. The invention of claim 2 wherein in said latch pin, during fuel dispensing, providing limited shifting for the latch ring of the fuel dispensing nozzle during usage.

4. The invention of claim 1 and including an automatic shut-off means contained within the nozzle, said latch pin operatively associated within the automatic shut-off means, and said latch pin having limited shiftability with respect to the automatic shut-off means during functioning of the nozzle to allow for shifting of the latch ring for opening of said port to allow for return of vapors back to the storage area, during initiation of operations of the nozzle during fuel dispensing, without automatically curtailing the dispensing of fuel when the nozzle is opened to dispense fuel.

5. A vapor valve for use in conjunction with a fuel dispensing nozzle, wherein the vapors are returned through the nozzle during recovery for transfer back to the underground fuel tank or other storage area, said nozzle incorporating a handle and body, and having a spout extending forwardly therefrom, the nozzle also incorporating a poppet valve operatively associated with the nozzle handle and when opened to provide for the flow of fuel through the nozzle, and said nozzle further incorporating an automatic shut-off means, responsive to nozzle generated vacuum pressures, for providing automatic shut-off of the nozzle when an automobile fuel tank reaches a fill condition, the automatic shut-off means incorporating an operating latch ring and plunger provided within a plunger housing, the body and spout having a passageway provided therethrough for communicating vapors collected at the automobile tank for return through the spout, and the nozzle body, for collection, a vapor return passageway communicating with the plunger housing of the automatic shut-off means contained within the nozzle body, said plunger housing cooperating with the nozzle body for return of the collected vapors through the nozzle body during the dispensing of fuel, valve seat operatively associated with the latch ring as shiftably contained within the plunger housing of the automatic shut-off means, whereby when said latch ring shifts against the valve seat provides for closure of the vapor return passageway when the dispensing of fuel is curtailed, thereby preventing the escape of the collected vapors from the nozzle body to the atmosphere during nonusage of the nozzle.

6. The invention of claim 5 and wherein said latch ring being shifted axially within the plunger housing by means of the manipulation of the plunger within the plunger housing during actuation of the nozzle during fuel dispensing and its shut-off.

7. The invention of claim 6 wherein said latch rings actuated through operations of the plunger, attains its limited axial shift within the plunger housing through slight displacement of the nozzle handle and its pivotal connection with the bottom of the nozzle plunger.

8. A vapor valve for use in conjunction with a fuel dispensing nozzle, wherein the vapors are returned through the nozzle during recovery for transfer back to the underground fuel tank or other storage area, said nozzle incorporating a handle and body, and having a spout extending forwardly therefrom, the nozzle incorporating an automatic shut-off means, the nozzle having a housing for embodying the automatic shut-off means, the nozzle body and spout having a passageway provided therethrough for communicating vapors collected at the automobile tank for return through the spout, and the nozzle body, for collection, said automatic shut-off means as located within the housing communicating with the vapor return passageway, said housing providing for return of the collected vapors through the nozzle body during the dispensing of fuel, a plunger incorporated in the automatic shut-off means and disposed within the housing, and valve means operatively associated with the nozzle plunger contained within the housing and providing for closure of the vapor return passageway when the dispensing of fuel is curtailed, when the automatic shut-off means initiates shut off of the dispensing of fuel, thereby preventing the escape of the collected vapors from the nozzle body to the atmosphere during nonusage of the nozzle.

* * * * *